US006846395B2

(12) United States Patent
Tanaka et al.

(10) Patent No.: US 6,846,395 B2
(45) Date of Patent: Jan. 25, 2005

(54) EDGE INSULATING MEMBER FOR ELECTRODE PLATE, METHOD OF LOCKING AND UNLOCKING THE EDGE INSULATING MEMBER, AND EDGE INSULATING MEMBER INSTALLATION JIG

(75) Inventors: Hiroshi Tanaka, Tokyo (JP); Fumihiko Shimizu, Iwaki (JP)

(73) Assignee: Mitsubishi Materials Corporation, Tokyo (JP)

( * ) Notice: Subject to any disclaimer, the term of this patent is extended or adjusted under 35 U.S.C. 154(b) by 64 days.

(21) Appl. No.: 10/297,578

(22) PCT Filed: Jun. 12, 2001

(86) PCT No.: PCT/JP01/04945

§ 371 (c)(1),
(2), (4) Date: May 27, 2003

(87) PCT Pub. No.: WO01/96629

PCT Pub. Date: Dec. 20, 2001

(65) Prior Publication Data

US 2004/0020765 A1 Feb. 5, 2004

(30) Foreign Application Priority Data

Jun. 12, 2000 (JP) ..... 2000-176027

(51) Int. Cl.[7] ..... C25C 7/02; C25C 7/06

(52) U.S. Cl. ..... 204/279; 204/281; 205/76; 205/557; 205/560; 205/575

(58) Field of Search ..... 204/279, 280, 204/281; 205/76, 557, 560, 575

(56) References Cited

U.S. PATENT DOCUMENTS

| | | | | | |
|---|---|---|---|---|---|
| 4,406,766 | A | * | 9/1983 | Macdonald | 204/281 |
| 5,314,600 | A | | 5/1994 | Webb et al. | |
| 5,549,801 | A | * | 8/1996 | Perlich et al. | 204/279 |
| 6,193,862 | B1 | * | 2/2001 | Cutmore et al. | 204/281 |
| 6,274,012 | B1 | * | 8/2001 | Santoyo | 204/279 |

FOREIGN PATENT DOCUMENTS

| | | |
|---|---|---|
| GB | 2174408 | 11/1986 |
| JP | 5-295586 | 11/1993 |

* cited by examiner

*Primary Examiner*—Roy King
*Assistant Examiner*—William T. Leader
(74) *Attorney, Agent, or Firm*—Oblon, Spivak, McClelland, Maier & Neustadt, P.C.

(57) ABSTRACT

The present invention relates to an edge insulation member for an electrode plate used for electrolytic refinement of metal, and to a fixing method for it. On a tip portion 22A of a main body 22, a fitting groove 23 and a jaw portion 24 for tightly fitting an electrode plate 1 are formed to extend along the lengthwise direction of the main body 22. On a base end portion of the main body 22, an engagement notch 25 for fitting a support rod 26 is formed to extend along the lengthwise direction of the main body 22. A plurality of pin insertion holes 27 are formed on the side surface of the jaw portion 24. Fitting jigs made up from a pin 30 and a stopper 40 is removably fitted in this pin insertion hole 27. The support rod 26 is removably fitted in the engagement notch 25.

19 Claims, 8 Drawing Sheets

EDGE INSULATING MEMBER FOR ELECTRODE PLATE, METHOD OF LOCKING AND UNLOCKING THE EDGE INSULATING MEMBER, AND EDGE INSULATING MEMBER INSTALLATION JIG

TECHNICAL FIELD

The present invention relates to an insulation member which is fitted on the edge portion of an electrode plate which is used during electrolytic refining of copper or the like, to a fixing method and a removal method therefore, and to a fitting jig for an edge insulation member.

TECHNICAL BACKGROUND

In a process for electrolytic refining of a metal such as copper or the like, and in particular in a long duration electrolytic refining and electrolytic sampling process, an electrode plate which is made from a metal such as stainless steel or the like is utilized as the cathode. This cathode is fitted into an electrolytic tank along with an anode which is made of blister copper or the like and electrolytic solution is filled therein; electrolysis is performed so that metal is precipitated and electrodeposited on both sides of the electrode plate. This is ablated so as to obtain the refined product in plate form (in the following, this precipitated and electrodeposited substance will be termed electrodeposited cathode material).

FIG. 8 and FIG. 9 are figures which show examples of the electrode plate; in these electrode plates 1, edge insulation members 2 are fitted on the circumferential edge portions of the electrode plates, so as to prevent the electrodeposited cathode material which is electrodeposited on both the sides of the electrode plate 1 from being connected to the edge portions of the electrode plate 1, and moreover so as to make it easy to ablate the electrodeposited cathode material, and further so as to ensure that it does not come into contact with both the cathodes.

As this type of edge insulation member 2, there are suggested, for example, ones such as those shown in FIG. 10 and FIG. 11. This type of edge insulation member 12 is one in which a fitting groove 13 and a jaw portion 14 for fixing the electrode plate are formed in its tip portion, so as to extend along the lengthwise direction of the edge insulation member 12.

When fitting this type of edge insulation member 12 to the electrode plate 1, the edge portion of the electrode plate 1 is inserted into the fitting groove 13, and is fixed in ten or more places with round pins 15. At this time, the edge insulation member 12 is fixed to the electrode plate 1 by fixing the edge insulation member 12, using insertion holes which are already formed in advance at predetermined positions in the edge insulation member 12 and the edge portion of the electrode plate 1, by fitting the electrode plate 1 so that these insertion holes are superimposed upon one another, by inserting the round pins 15 into these insertion holes, and by fusing the head portions of the round pins 15.

This type of edge insulation member 12 and round pins 15 may be made from a common resin such as vinyl chloride, polypropylene or the like.

Furthermore, in order to fill in any gap between the electrode plate 1 and the edge insulation member 12 which may be caused by deformation or thermal expansion or the like of the resin from which the edge insulation member 12 is made, and in order to close up the tightly fitting portion of the edge insulation member 1 against the electrode plate 1, wax 16 is flowed over this portion and solidified, so that it is ensured that no electrolytic solution can insinuate itself into this tightly fitted portion.

However, there are the following problems with this type of edge insulation member 12.

In the first place, since, along with it being necessary to form the wax portion 16 each time the edge insulation member 12 is fixed to the electrode plate 1, also it is necessary to remove the wax 16 each time the process of ablation of the electrodeposited cathode material from the electrode plate 1 is performed, accordingly the work involved in each process has become onerous, and the removal and fitting of the edge insulation member 12 to the electrode plate 1 has been very troublesome.

In the second place, it sometimes has happened that the quality of the refined material which is obtained during the electrolytic refinement process has been deteriorated, due to some of the wax 16 undesirably adhering or mixing in to the electrodeposited cathode material.

In the third place, since the thermal deformation coefficient of the resin from which the edge insulation member 12 is formed is large, accordingly the quality of secure engagement between the edge insulation member 12 and the electrode plate 1 is bad, and it is necessary to fix a large number of places with the round pins 15 as described above, so that the work becomes complicated and also excess cost is generated.

In the fourth place, since the head portions of the round pins 15 are fused to the edge insulation member 12, accordingly removal of the round pins 15 from the edge insulation member 12 has been troublesome. Furthermore, it has not been possible to reuse the edge insulation member 12 after the round pins 15 have been removed.

In the fifth place, it has sometimes happened that the round pins 15 have been broken away from the edge insulation member 12 due to shock when ablating the electrodeposited cathode material from the electrode plate 1.

In the sixth place, it has sometimes happened that electrolytic solution has permeated from the gap of the pin insertion holes of the edge insulation member 12 and the electrode plate 1, and that electrodeposited material which has accreted upon the electrode plate 1 has caused failure of the edge insulation member 12 and of the round pins 15.

In this manner, with a prior art edge insulation member 12, not only is the process of fitting and removal to the electrode plate 1 troublesome, but the quality of secure engagement to the electrode plate 1 has been inadequate; and even with a fixing method for supplementing this, in other words even with attachment with pins as well, it is necessary to form them in large numbers, and furthermore the work is complicated, and yet further there have been problems with the insulation characteristics of such portions. Furthermore, the anti impact characteristics and so on have deteriorated in strength. Even furthermore, there has been the problem that the quality of the refined product has been undesirably deteriorated by the use of the wax 16.

SUMMARY OF THE INVENTION

The present invention has been conceived in order to resolve the problems, and its objective is, with an edge insulation member of an electrode plate which is used in an electrolytic refining process:

(1) to facilitate its removal from and fitting to the electrode plate;

(2) to be able to enhance its secure engagement to the electrode plate, to be able completely to insulate the edge portion of the electrode plate, and to be able to maintain this quality of secure engagement over a long time period;

(3) to enhance the strength of the anti impact characteristic and the like;

(4) to make the work of ablation of the electrodeposited cathode material from the electrode plate during the electrolytic refinement process easier; and (5) to eliminate mixing of material generated from the edge insulation member into the electrodeposited cathode material, in order to obtain a refined material with good product quality.

In order to resolve the above problems, the present invention proposes an edge insulation member which is attached to an edge portion of an electrode plate during a process of electrolytic refinement of a metal. This edge insulation member includes a rod shaped main body, a fitting jig which consists of a pin and a stopper, and a support rod. On a tip portion of the rod shaped main body, a fitting groove and a jaw portion for tightly fitting the electrode plate are formed to extend along the lengthwise direction of the main body. On a base end portion of the main body, an engagement notch for fitting the support rod is formed to extend along the lengthwise direction of the main body. A plurality of pin insertion holes are formed on the side surface of the jaw portion. The fitting jig is removably fitted in the pin insertion hole, and the support rod is removably fitted in the engagement notch.

According to this type of edge insulation member, it can be easily removed from and attached to the electrode plate, and it is possible to enhance the secure engagement state between the edge insulation member and the electrode plate, and it is possible to increase the quality of insulation of the electrode plate edge portion.

The stopper may comprise: a ring shaped fixing portion which can be fixed into the pin insertion hole of the insulation member; an insertion hole which is provided so that its diameter reduces from this fixing portion towards the other end; and a slit sleeve which is provided on the side wall surface of the reducing diameter portion of this insertion hole, and in which a slit has been formed in its longitudinal direction; and may have a structure in which, by inserting the pin into this slit sleeve, the slit sleeve is expanded in the circumferential direction.

Furthermore, the pin may comprise a main body, a grip portion which is formed upon a starting end portion of the main body, and one or a plurality of key portions which are formed on side surfaces of the main body.

Furthermore, the slit sleeve may comprise an inclined portion which makes an angle of inclination of 3° to 45° with respect to the direction of insertion of the pin.

According to this type of fitting jig which is made up from a pin and a stopper, since the in is more strongly fixed than the stopper and is hard to remove, and the stopper is securely engaged to the electrode plate, thereby it is possible strongly to fix the edge insulation member to the electrode plate.

Furthermore, the main body of the edge insulation member and the fitting jig may be made from resin, with the stopper being made from an elastomer whose elasticity is higher than the resin which is used for the main body and pin. By in this manner using a resin for the fitting jig and using an elastomer whose elasticity is high for the stopper, it is possible to enhance the quality of secure engagement between the stopper and the pin, and the quality of secure engagement between the stopper and the electrode plate, and it is possible strongly to fix the edge insulation member to the electrode plate. Yet further since it is possible to absorb deviation between the electrode plate and the edge insulation member which is caused by stress which is experienced when fixing the edge insulation member or when ablating electrodeposited cathode material or the like, or deviation between those two elements which is caused when the temperature is high during electrolysis due to differences in the coefficients of thermal expansion between the electrode plate and the edge insulation member, by the stopper, accordingly it is possible to maintain the secure engagement together of the edge insulation member and the electrode plate over a long time period.

Furthermore, at least one of the main body, the fitting jig made up of the pin and the stopper, and the support rod may consist of a metal core enclosed within a resin.

Furthermore, the support rod may be a circular cylindrical body with a circular cross sectional shape, or may be an elliptical cylindrical body with a elliptical cross sectional shape.

Furthermore, a seal member may be adhered to the surface of the fitting groove. Yet further, an adhesive layer may be provided on the surface of the fitting groove.

Furthermore, the present invention proposes a fixing method for an edge insulation member, for fixing an edge insulation member to an edge portion of an electrode plate. This fixing method includes: a process of forming a plurality of pin insertion holes at predetermined places of the electrode plate edge portion; a process of fitting the electrode plate to the fitting groove of the edge insulation member, so that the pin insertion holes of this electrode plate edge portion are superimposed upon the pin insertion holes of the above described edge insulation member; a process of tightly fitting the electrode plate in the fitting groove with the groove width narrowed down, by fitting the support rod in the engagement notch of the edge insulation member so as to expand the engagement notch; a process of fitting the stopper in the pin insertion hole of the edge insulation member; and a process of inserting the pin in the pin insertion hole of the edge insulation member and the pin insertion hole of the electrode plate, fixing this pin by the stopper, and fixing the edge insulation member to the electrode plate.

Furthermore, in this fixing method for an edge insulation member, as the stopper, there may be utilized one including a ring shaped fixing portion which is fixed in the pin insertion hole of the insulation member, an insertion hole which is provided so as to reduce in diameter from this fixing portion towards its other end, and a slit sleeve which is provided on the side wall surface of the reducing diameter portion of this insertion hole, and with a slit being formed in its longitudinal direction; and there may be further included a process of inserting the pin into this stopper, and expanding the slit sleeve of the stopper in the circumferential direction, so as securely to engage the slit sleeve to the electrode plate.

According to this type of fixing method for an edge insulation member to an electrode plate, the fixing of the edge insulation member to the electrode plate is easy, and it is possible to increase the quality of secure engagement between the edge insulation member and the electrode plate. Furthermore, since no impurity is mixed in with the electrodeposited cathode material since no wax is used, the ablation of the cathode electrodeposited material from the cathode plate becomes yet easier.

Furthermore, as the support rod, there may be used a circular cylindrical body with a circular cross sectional shape, or an elliptical cylindrical body with a elliptical cross sectional shape.

Furthermore, the electrode plate may be fitted into the fitting groove of the edge insulation member by inserting the electrode plate into the fitting groove of the edge insulation member, and by adhering a seal member which is adhered to the surface of the fitting groove to the electrode plate.

Furthermore, the electrode plate may be fitted into the fitting groove of the edge insulation member by inserting the electrode plate into the fitting groove of the edge insulation member, and by securely engaging an adhesive layer which is provided on the surface of the fitting groove to the electrode plate.

Furthermore, at least one of the main body, the fitting jig made up of the pin and the stopper, and the support rod may have a metal core enclosed within a resin.

Furthermore, the present invention proposes a removal method for an edge insulation member. The removal method includes taking out the support rod of an edge insulation member which is fixed to the electrode plate by the above fixing method for an edge insulation member from the engagement notch, removing the grip portion of the pin by grinding, and removing the edge insulation member from the electrode plate by extracting the pin.

Furthermore, the present invention proposes a fitting jig. This fitting jig includes a stopper and a pin which fix an edge insulation member which is fitted to an edge portion of an electrode plate which is used in a process of electrolytic refining of a metal to the electrode plate. The pin includes a main body, a grip portion which is formed at a starting end portion of the main body, and one or a plurality of key portions which are formed on side surfaces of the main body; and the stopper includes a ring shaped fixing portion, an insertion hole which is provided so as to reduce in diameter from this fixing portion towards its other end, and a slit sleeve which is provided on the side wall surface of the reducing diameter portion of this insertion hole, and with a slit being formed in its longitudinal direction; and has a structure such that, by the pin being inserted into the stopper, the slit sleeve is expanded in the circumferential direction, so as to fix the pin.

According to this type of fitting jig, along with being able strongly to fix the edge insulation member to the electrode plate, it is also easy to remove it.

BRIEF DESCRIPTION OF THE DRAWINGS

FIG. 3B is a plan view showing this stopper of the edge insulation member according to the present invention, and FIG. 3A is a sectional view showing a portion A-A' of the plan view shown in FIG. 3B.

PREFERRED EMBODIMENTS FOR IMPLEMENTATION OF THE INVENTION

In the following, the present invention will be described in concrete terms with reference to embodiments thereof.

Figure 1:
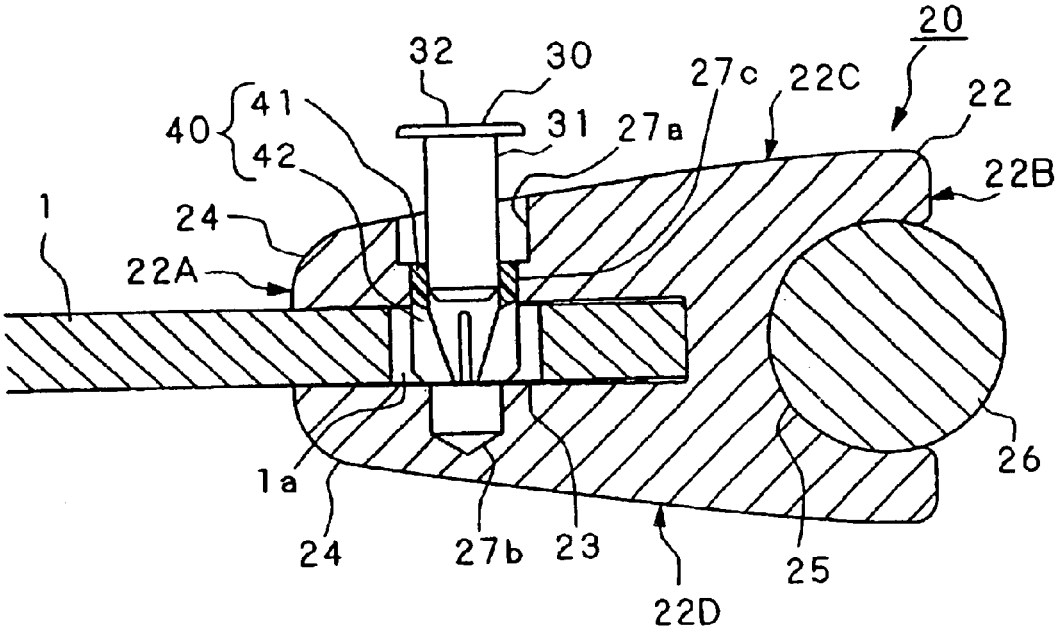
FIG. 1 is a schematic cross sectional figure showing an example of an edge insulation member according to the present invention, as fitted to an electrode plate.
Figure 2:
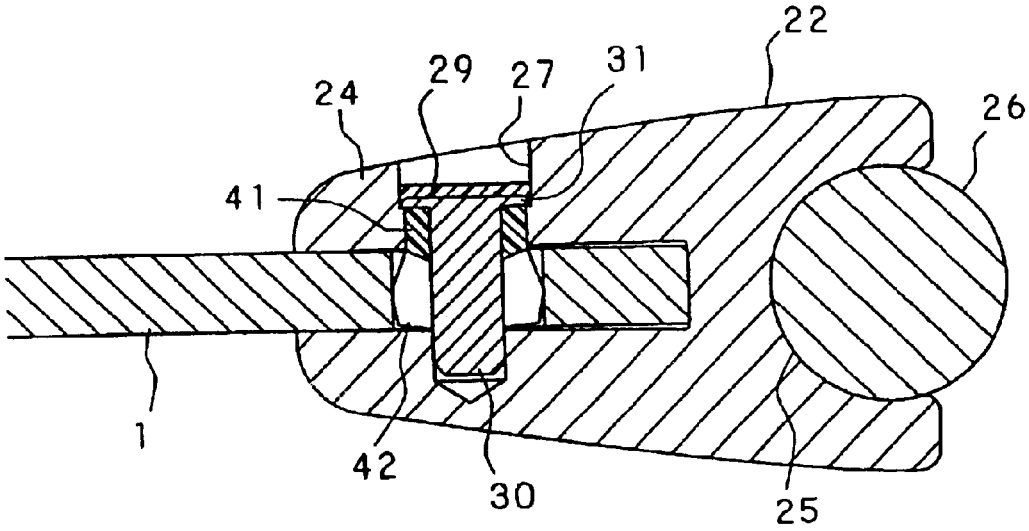
FIG. 2 is a schematic cross sectional figure showing an example of an edge insulation member according to the present invention, as fixed to an electrode plate.

FIGS. 1 and 2 show a first embodiment of the edge insulation member of the present invention, and are figures showing the state in which it is tightly fitted to an electrode plate.

Figure 8:
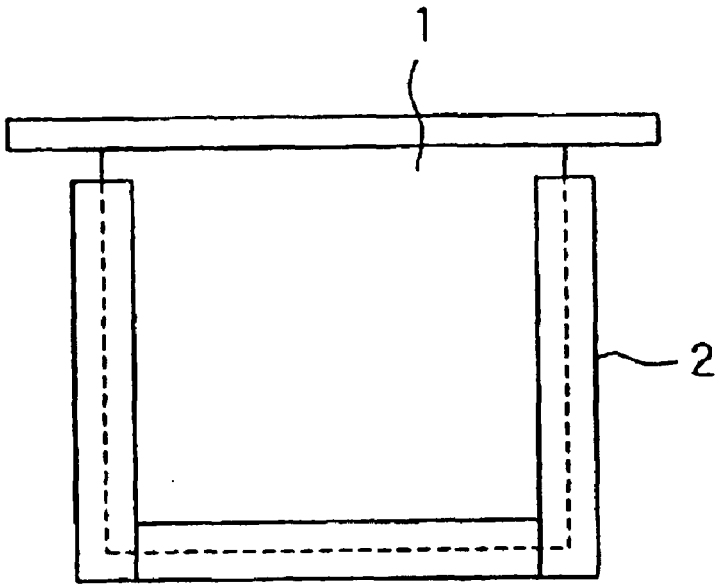
FIG. 8 is a plan view showing examples of an electrode plate and an edge insulation member.
Figure 9:
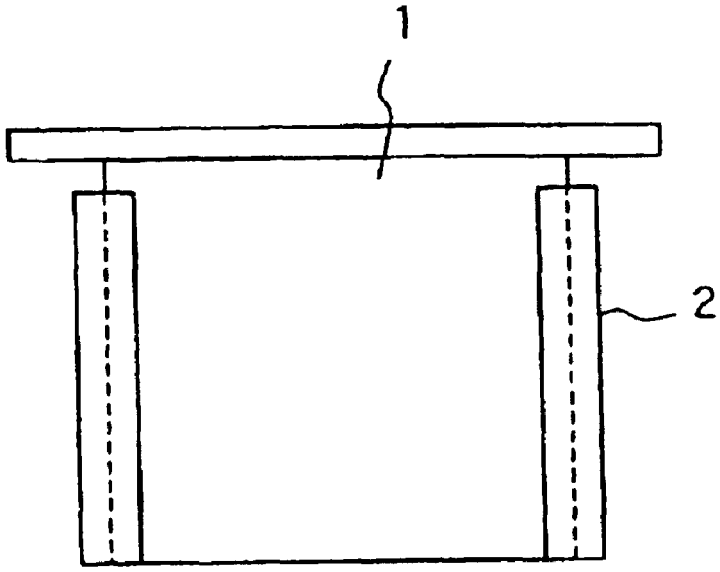
FIG. 9 is a plan view showing examples of an electrode plate and an edge insulation member.
Figure 10:
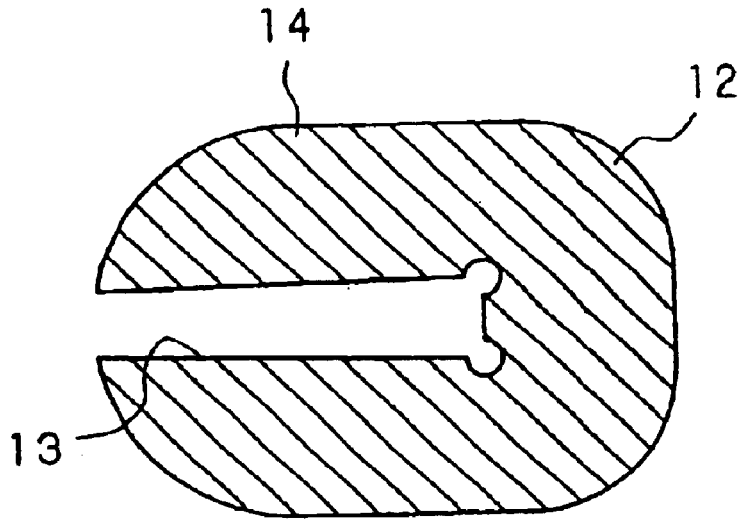
FIG. 10 is a sectional view showing an example of a prior art edge insulation member.
Figure 11:
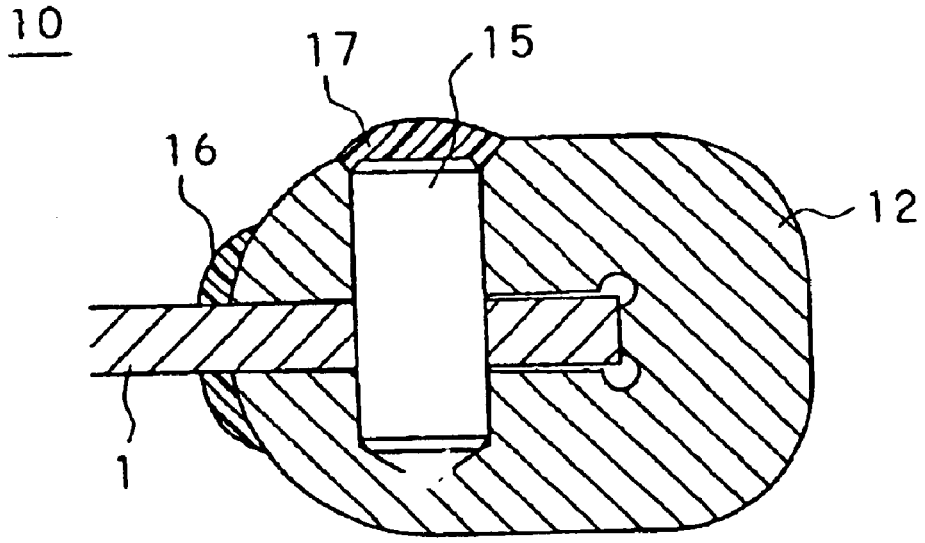
FIG. 11 is a sectional view showing an example of a prior art edge insulation member, when an electrode plate has been fixed.

This type of edge insulation member 20 is used, during electrolytic refining, by being fitted to both the edge portions and the lower edge portion of an electrode plate 1 as shown in FIG. 8, or to both the edge portions of the electrode plate as shown in FIG. 9.

The edge insulation member 20 includes a cylindrically shaped (rod shaped) main body 22, a fitting jig made up from a pin 30 and a stopper 40, and a support rod 26.

A fitting groove 23 and a jaw portion 24 for fitting the electrode plate 1 are formed at a tip portion 22A of the main body 22 so as to extend along the lengthwise direction of the main body 22. The fitting groove 23 is provided for fitting the electrode plate 1 to the main body 22, and it is constituted so as to change the cross sectional shape by the jaw portion 24. When the electrode plate 1 is fitted into the fitting groove, the opening cross sectional area of the fitting groove 23 is desirably from 5% to 20% of the entire cross sectional area of the main body 22, and more desirably is from 15% to 20% thereof.

The groove width of the fitting groove 23 can be adjusted so as to make the jaw portion 24 to tightly fit the electrode plate 1 which is fitted into the fitting groove 23, or so that it can be removed.

On the other hand, an engagement notch 25 in which the support rod 26 is fitted is formed in a base end portion 22B of the main body 22 so as to extend in the lengthwise direction of the main body 22. The support rod 26 is fitted in this the engagement notch 25 so that it can be removed therefrom and refitted thereto, and is made so that, by fitting the support rod 26, the cross sectional area of the engagement notch 25 is widened.

Figure 12:
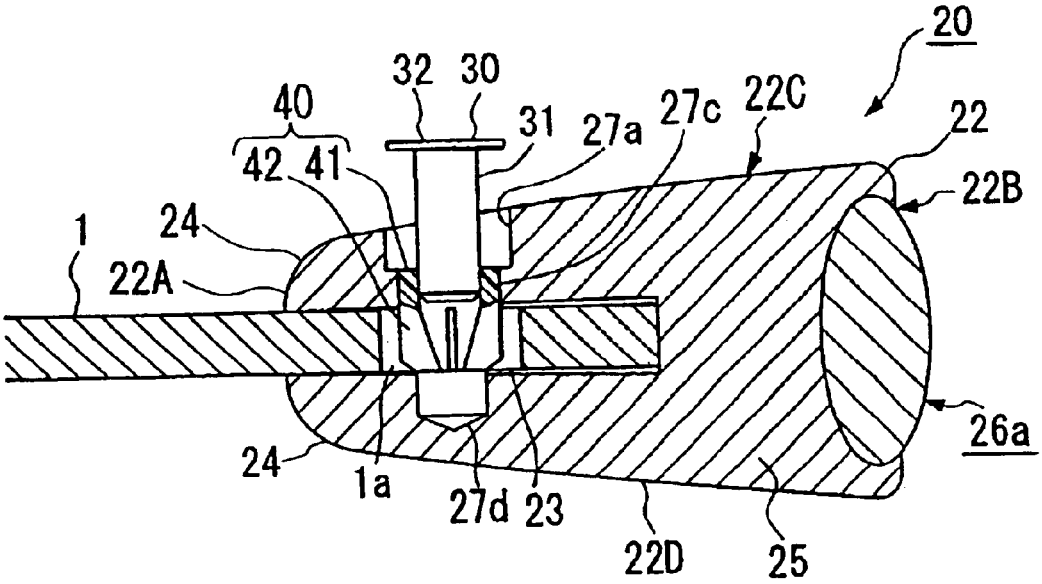
FIG. 12 is a schematic cross sectional figure showing an example of an edge insulation member according to the present invention, when it has been fitted to an electrode plate.
Figure 13:
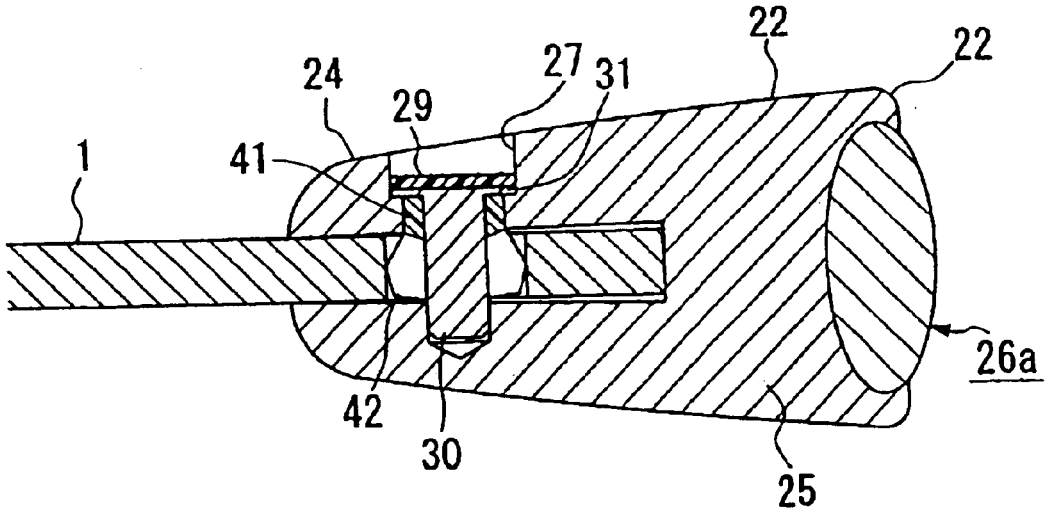
FIG. 13 is a schematic cross sectional figure showing an example of an edge insulation member according to the present invention, when it has been fitted to an electrode plate.

The cross sectional shape of the support rod 26, as shown in FIGS. 1 and 2, is a circular cylindrically shaped body of round form which has a diameter somewhat greater than the engagement notch 25. Or, as shown in FIGS. 12 and 13, its cross sectional shape may be an elliptical cylindrically shaped body 26*a* which exhibits an elliptical shape. The support rod 26 or 26*a* can be removed from or engaged into the engagement notch 25 by gripping and rotating its rotational structure.

The main body 22 is formed so that the groove width of the fitting groove 23 is adjusted by the force which has been applied to the engagement notch 25 by fitting the support rod 26 into the engagement notch 25 being transmitted to the jaw portion 24.

Furthermore, the main body 22 is formed so that the space between the side surface 22C and the side surface 22D which extend between the fitting groove 23 and the engagement notch 25 narrows down from the base end portion 22B towards the tip portion 22A.

Furthermore, a pin insertion hole 27 (27*a*, 27*b*, 27*c*) is formed in the jaw portion 24, in the direction of the side surface 22D from the side surface 22C. A fitting jig which consists of a pin 30 and a stopper 40 for fixing the electrode plate 1 to the main body 22 is fitted in this pin insertion hole 27, so as to be removable and re-attachable.

Figure 3B:
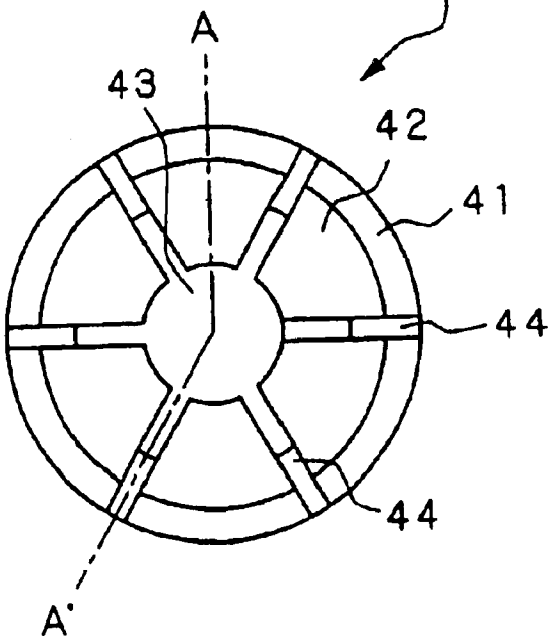
FIGS. 3A and 3B show an example of a stopper of an edge insulation member according to the present invention.
Figure 3A:
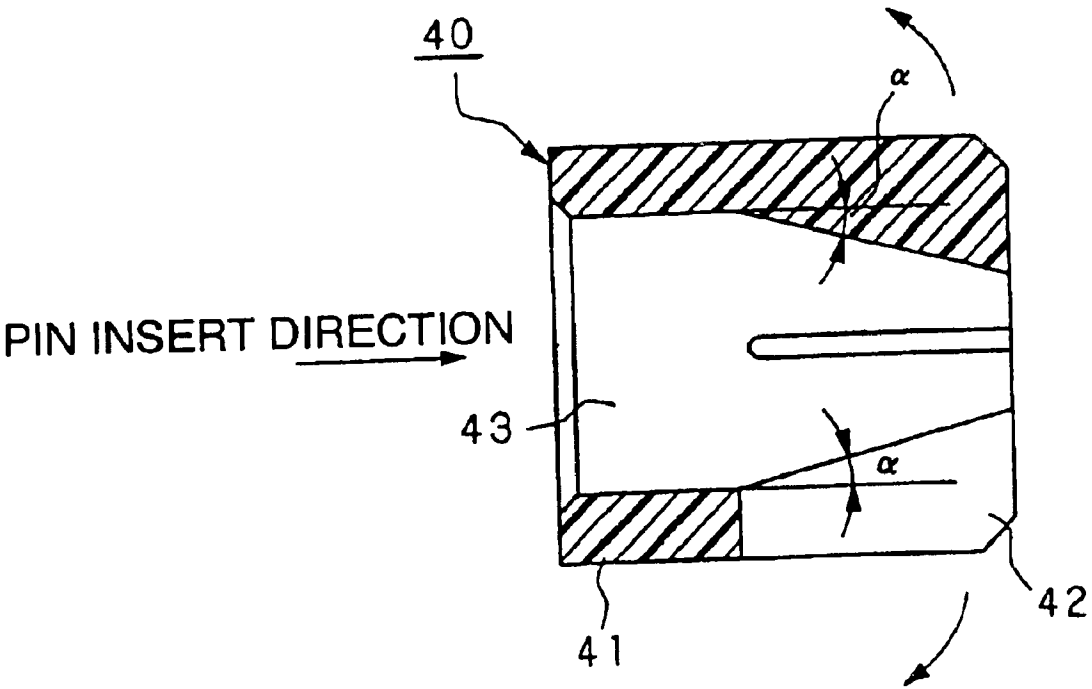

FIGS. 3A and 3B are figures which show an example of the stopper 40. FIG. 3B is a plan view as seen from the direction opposite to the direction in which the pin is inserted, while FIG. 3A is a side view as seen from the section A-A' shown in FIG. 3B.

The stopper 40 is a tubular shaped member which includes a ring shaped fixing portion 41 which is capable of being fixed in the pin insertion hole 27, an insertion hole 43 which is provided along the axially central portion of the stopper 40 so as to reduce in diameter in the direction from the fixing portion 41 towards the other end thereof, and a slit sleeve 42 which is provided in the side wall surface of the reducing diameter portion of the insertion hole 43, and which is formed with slits in the longitudinal direction. The slit sleeve 42 is made so as to open up towards the outer side of the radial direction by the pin 30 being inserted into the insertion hole 43.

The diameter of the slit sleeve 42 which is provided at the side wall surface of the reducing diameter portion of the insertion hole 43 is desirably equal to or greater than ½ of the diameter of the insertion hole 43 in the fixing portion 41, and more desirably is from ½ to 1 thereof. Furthermore, the slit sleeve 42 is desirably made so as to have an inclined portion whose angle of inclination a with respect to the direction in which the pin 30 is inserted is from 3° to 45°. By providing this inclined portion so as to have the range of angle of inclination, along with the insertion and the withdrawal of the pin 30 becoming smooth, it is possible to fix the pin 30 securely.

The slit sleeve 40 is made so as to be fitted, as shown in FIG. 2, into the pin insertion hole 27 which has been formed in the jaw portion 24 of the main body 22, with the fixing portion 41 being securely engaged in the third insertion hole 27*c*, while the slit sleeve 42 is engaged in a first insertion hole 1*a* portion of the electrode plate 1.

The pin 30 is an element which has a pin main body 31 and a grip portion 32 which is formed to have a diameter greater than this pin main body 31. The basic construction for this type of pin 30 is considered to be the circular cylinder shape shown in FIG. 1 and FIG. 2, but by way of example, as an alternative, a construction such as the one shown in FIG. 4 or FIG. 5 may be considered.

Figure 4:
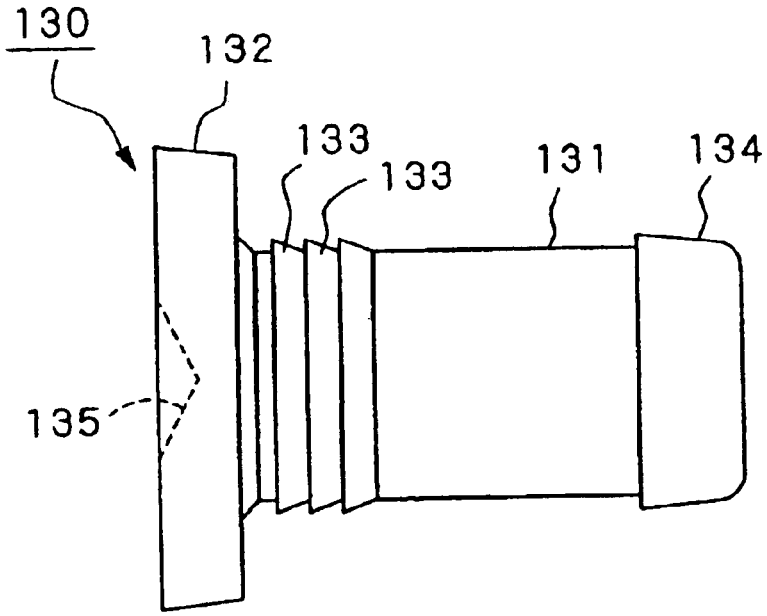
FIG. 4 is a side view showing an example of a pin of an edge insulation member according to the present invention.

With the pin 130 shown in FIG. 4, a grip portion 132 is formed at the starting end portion of the main body 131, and a plurality of key portions 133 (in the shown case, three) are formed on the side surface of the end portion of the main body 131 on the side of this grip portion 133. By contrast to this, the tip portion 134 of the pin 130 at the other end portion of the main body 131 is formed smoothly so as to have no comers, and moreover is formed so as to have a diameter greater than that of the main body 131. Furthermore, a circular cone shaped hole (a so called punch) 135 is formed in the central portion of the grip portion 132.

Figure 5:
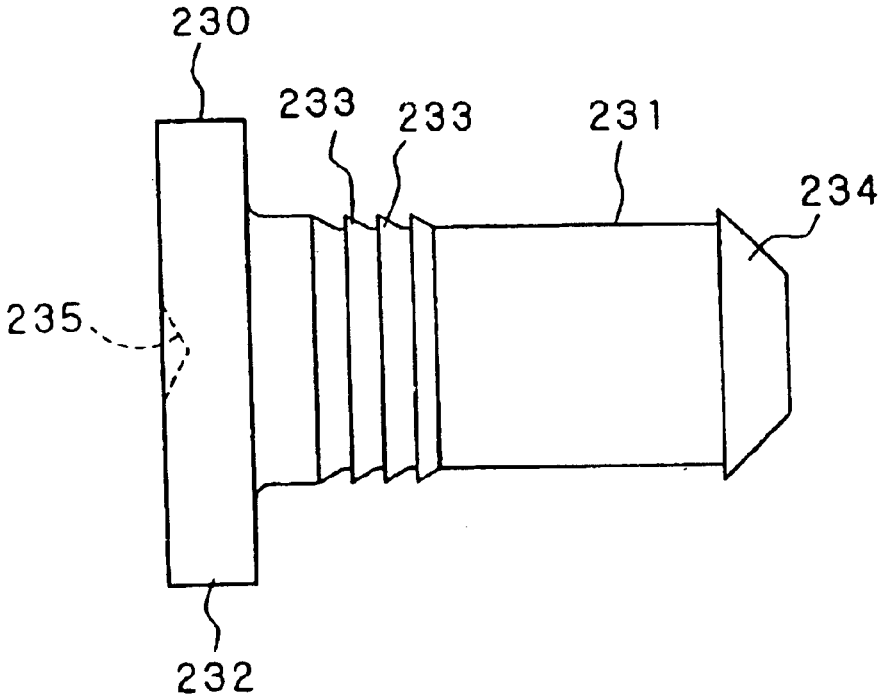
FIG. 5 is a side view showing an example of a pin of an edge insulation member according to the present invention.

With the pin 230 shown in FIG. 5, in the same manner as shown in FIG. 4, a grip portion 232 is formed at the starting end portion of the main body 231, and a plurality of key portions 233 (in the shown case, three) are provided on the side surface of the end portion of the main body 231 on the side of this grip portion 233. Furthermore, a punch 235 is formed in the central portion of this grip portion 232. And, with this pin 230, a key shaped tip portion 234 is provided. With this tip portion 234, the diameter of the boundary surface between the main body 231 and the tip portion 234 is set to be somewhat greater than the diameter of the main body 231, and moreover the diameter reduces from the boundary surface towards the direction of the tip portion, so that the diameter at the tip portion is set so that it becomes smaller than the diameter of the main body 231.

Figure 6:
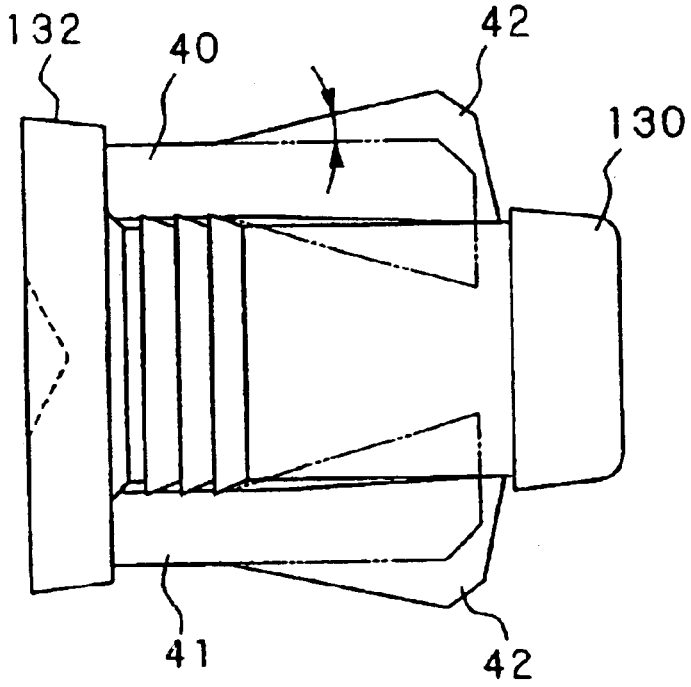
FIG. 6 is a side view showing an example when a pin of an edge insulation member according to the present invention has been inserted into a stopper.
Figure 7:
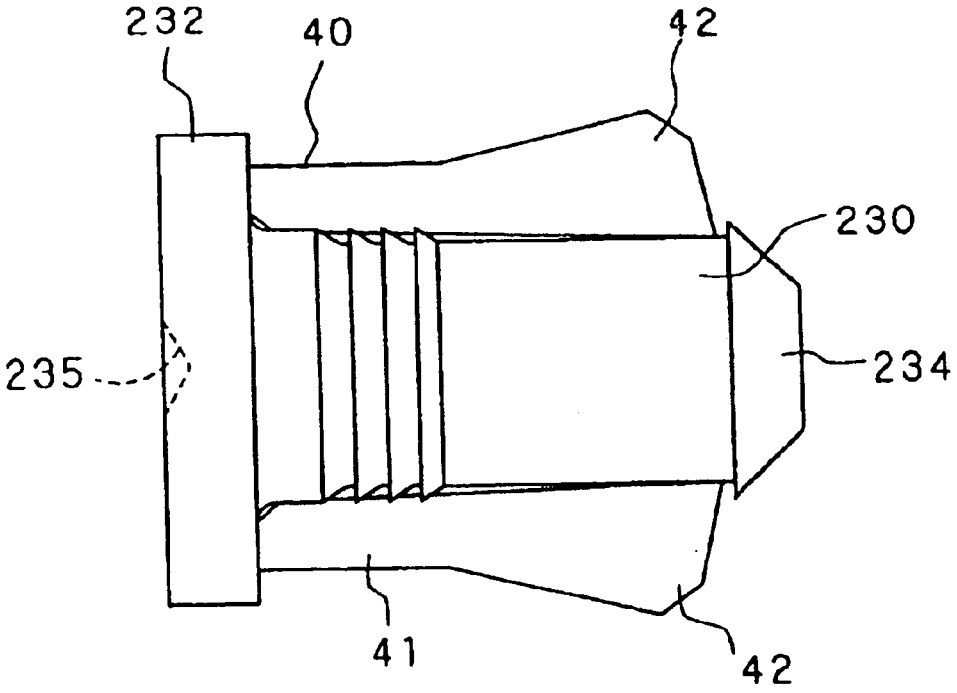
FIG. 7 is a side view showing an example when a pin of an edge insulation member according to the present invention has been inserted into a stopper.

FIG. 6 is one which shows the state when the pin 130 shown in FIG. 4 has been inserted into the stopper 40 of the construction shown in FIG. 3. Furthermore. FIG. 7 is one which shows the state when the pin 230 shown in FIG. 5 has been inserted into the stopper 40.

As shown in FIG. 6 or FIG. 7, by inserting the pin 130 or 230 into the insertion hole 43 of the stopper 40, the slit sleeve 42 of the stopper 40 is set so as to be pressed and expand in the circumferential direction. And the pin 130 or 230 is securely engaged and fixed in the insertion hole 43 of the stopper 40 by the restoring force from the slit sleeve 42. Furthermore, due to the grip portion 132 or 232, along with it being possible to retain the pin 130 or 230 in the stopper 40, it is also possible to ensure that no electrolytic solution invades to within the interior of the stopper 40.

Furthermore, due to the provision of the key portion 133 or 233, it is made harder for the pin 130 or 230 to come out from the stopper 40. Furthermore, putting in of the pin 30 is easy, due to the fact that the tip portion of the pin is smooth like the tip portion 134 shown in FIG. 4, or is key shaped like the tip portion 234 shown in FIG. 5. Furthermore, due to the fact that the diameter of the tip portion 134 or 234 is greater than the diameter of the pin main body 131 or 231 at the boundary surface between the pin main body 131 or 231 and the tip portion 134 or 234, thereby the tip portion 134 or 234 is held into the stopper 40, and it becomes harder for the pin 130 or 230 to come out.

The pin insertion hole 27 which is formed in the side surface of the jaw portion 24 of the edge insulation member 20, as shown in FIG. 1, is formed so as to accommodate the fitting jig which consists of the pin 30 and the stopper 40. The pin insertion hole 27 is made up from a first insertion hole 27*a* whose hole diameter is made the same as that of the grip portion 32 of the pin 30, a second insertion hole 27*b* whose diameter is made the same as that of the main body of the pin 30, and a third insertion hole 27*c* whose diameter is made the same as that of the fixing portion 41 of the stopper 40. The first insertion hole 27*a* and the third insertion hole 27*c* are provided in the side surface of the jaw portion 24 on the side where the pin 30 is initially inserted, and the second insertion hole 27*b* is provided in the other jaw portion 24, so as only to open to the fitting groove 23.

The stopper 40 is fitted into this third insertion hole 27*c*, and is formed so that the grip portion 32 of the pin 30 is fixed at the boundary between the first pin insertion hole 27*a* and the third pin insertion hole 27*c*.

This edge insulation member 20 (including the main body 22, the pin 30, and the stopper 40) desirably has, as its principal ingredient, polyphenylene ether type resin or super engineering plastic or the like, or, in concrete terms, polyphenylene ether and high impact polystyrene resin.

Furthermore, in order further to enhance the anti-shock characteristic of the edge insulation member 20, and the mechanical strength with respect to external stress, it is also possible to utilize, for at least one of the main body 22, the pin 30, the stopper 40, and the support rod 26 which make up the edge insulation member 20, a structure in which a metal core made from stainless steel or titanium or the like is covered over with one of the above described resins. At this time the metal core should be completely covered over with resin, so that its surface may not come into contact with the electrolytic solution. The proportion of the metal core which is included in the edge insulation member 20 with respect to the entire mass of the edge insulation member 20 is desirably from 40% to 90% by weight, and more desirably is from 70% to 90% by weight. If the proportion of the metal core is less than 40% by weight, then the strength of the metal core exhibits a tendency to be insufficient, while if it is greater than 90% by weight, the strength of the surface layer of resin with which the metal core is covered exhibits a tendency to be insufficient.

If this type of resin is used, it is possible to provide a unit which excels in acid resistance, heat resistance, and strength. If in this manner the edge insulation member 20 is made to be excellent in acid resistance, it is not corroded by the electrolytic solution, and it can be used over a long time period. Furthermore, if the edge insulation member 20 is made to be excellent in heat resistance, then its shape is not greatly deformed even if during electrolysis the temperature of the electrolytic solution becomes 40° C. to 50° C. above ambient temperature, so that it is possible to maintain a high degree of secure engagement with the electrode plate 1. Furthermore, since the strength of the edge insulation member 20 is excellent, it is not destroyed even by the impact forces which it experiences during the process of ablation of electrodeposited cathode material, or by stress or the like which it experiences during fitting or during transportation. Furthermore, since the resin is excellent in extrusion formability, the jaw portions 24 of the edge insulation member 20 and so on can be formed with uniformly good dimensional accuracy. Furthermore, it is possible further to enhance the anti impact characteristic of the edge insulation member 20 and the mechanical strength with respect to external stress, by enclosing a metal core in the interior of a resin. At this time the surface of the metal core is completely covered over with the resin, so that it is completely separated from the electrolytic solution.

Furthermore, it is desirable for an elastomer to be used for the stopper 40 which has a higher elasticity than the resin which is used for the main body 22 and the pin 30 (130, 230). As concrete examples of the elastomer, there may be suggested polyester type resin, polyolefin type resin, styrene type resin, biphenyl chloride type resin, fluorinated resin or the like.

By manufacturing the stopper 40 by using such a type of elastomer, it is possible securely to engage the stopper 40 to the pin 30 (130, 230) when fixing the pin 30 (130, 230), and to make it difficult for the pin 30 (130, 230) to come out from the pin insertion hole 27. Furthermore, it is possible securely to engage the stopper 40 in the pin insertion hole 1*a* of the electrode plate 1, and it is possible to prevent the electrolytic solution from insinuating itself into this portion. Yet further, since it is possible to absorb deviation between the fixing portions caused by difference in the rates of thermal expansion of the edge insulation member 20 and the electrode plate 1 and the like by this stopper 40, no gap is generated between the edge insulation member 20 and the electrode plate 1.

Figure 14:
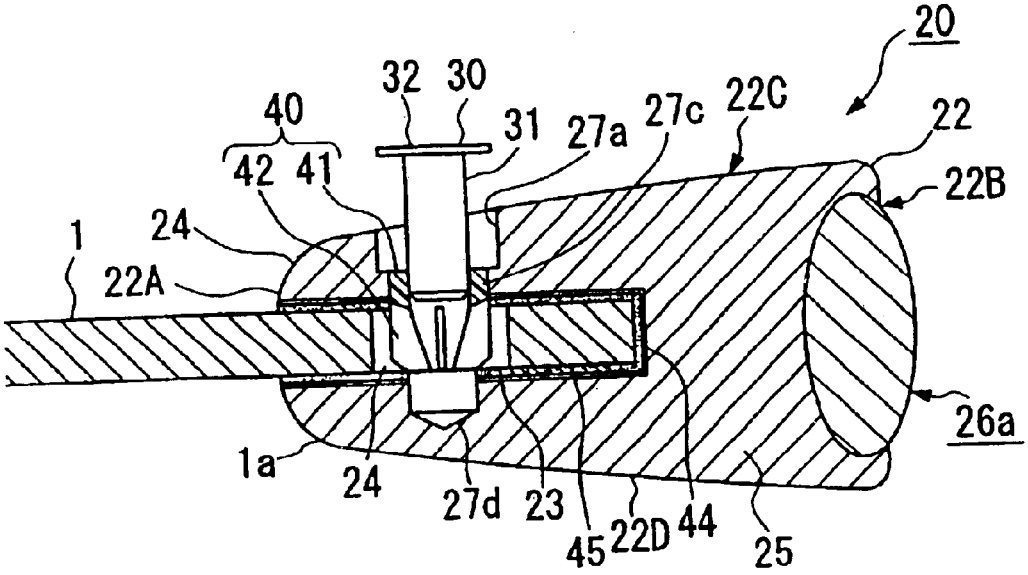
FIG. 14 is a schematic cross sectional figure showing an example of an edge insulation member according to the present invention, when it has been fitted to an electrode plate.
Figure 15:
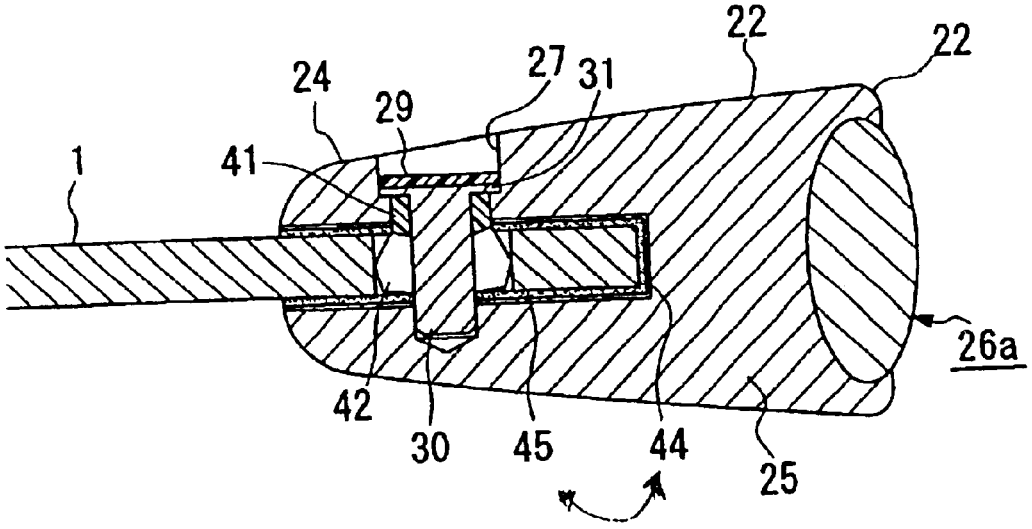
FIG. 15 is a schematic cross sectional figure showing an example of an edge insulation member according to the present invention, when it has been fitted to an electrode plate.

Furthermore, as shown in FIG. 14 and FIG. 15, it is possible to fit a seal member 44 to the surface of the fitting groove 23. By providing the seal member between the bonding groove 23 and the electrode plate 1, it is possible to enhance the secure engagement between the edge portion insulation member 20 and the electrode plate 1, and it is possible to prevent contact between the electrolytic solution and the electrode plate 1. For the seal member 44, adhesive tape may be used. For the adhesive tape, it is possible to use a base substance having as its principal component a polyester resin, a polypropylene resin, a fluorinated resin or the like, with an adhesive containing a composite resin such as an acrylic resin or a type of rubber or the like painted on its one surface.

Furthermore it is possible further to provide an adhesive layer 45 which is made by spreading an adhesive substance between the seal member 44 and the electrode plate 1. By doing this, it is possible to enhance the security of the engagement between the seal member 44 and the electrode plate 1, and it is possible to intercept contact between the electrolytic solution and the electrode plate 1. As the adhesive substance, it is possible to utilize an acrylic type adhesive substance, an epoxy type adhesive substance, an olefin type adhesive substance, or the like. Furthermore, the adhesive layer 45 may be provided between the seal member 44 and the surface of the fitting groove 23. Furthermore, the adhesive layer 45 may be provided upon both sides of the seal member 44, and thereby the fitting groove 23 and the electrode plate 1 may be more firmly fixed together. The main body 22 of the edge insulation member 20 may be manufactured by extrusion molding.

The pin 30 and the stopper 40 may be made by injection molding. Furthermore, the above described pin insertion hole 27 may conveniently be made by mechanical drilling, after the edge insulation member 20 has been manufactured.

Next, in order to fix this type of edge insulation member 20 to the electrode plate 1, a fixing method for the edge insulation member 20 will be explained.

As shown in FIG. 2, a pin insertion hole 1*a* is formed in advance in the edge portion of the electrode plate 1. In order to superimpose this pin insertion hole 1*a* upon the pin insertion hole of the edge insulation member 20, the electrode plate 1 is inserted into the fitting groove 23 of the edge insulation member 20. By the way, the electrode plate 1 is caused to be tightly fitted by the jaw portion 24 of the main body 22, by fitting the support rod 26 into the engagement notch 25 of the main body 22, so as to open up the engagement notch 25. At this time, by securely engaging the seal member 44, or the adhesive layer 45, which is provided upon the surface of the fitting groove 23, to the electrode plate 1, it is possible to fit the electrode plate 1 more tightly.

Next, the stopper 40 is fitted into the pin insertion hole 27 which has been provided in the jaw portion 24. By inserting the pin 30 into this pin insertion hole 27, the topper 40, and the pin insertion hole 1*a* of the electrode plate 1, this pin 30 is fixed with the stopper 40.

At this time, it is possible to close up the interior of the pin insertion hole 27 by spreading upon the head portion of the pin 30, in other words on the grip portion 32, a masking material 29 such as a thermosetting adhesive substance or a silicon caulking material or the like. By doing this, it is possible to prevent the entry of the electrolytic solution even more, and it is possible to enhance the degree of insulation of the interior.

Furthermore, it is desirable to ensure that the hole diameter of the pin insertion hole 1*a* of the electrode plate 1 is somewhat fatter diameter than the outer diameter of the stopper 40, so that the stopper 40 is securely engaged when the pin 30 is inserted.

If this type of fixing method is adopted, since the slit sleeve 41 of the stopper 40 is expanded in the outward circumferential direction by the insertion of the pin 30, and is thus securely engaged to the electrode plate 1, thereby, along with firmly fixing the pin 30, there is no ingress of the electrolytic solution into the tightly fitted portion (the fitting groove 23) of the electrode plate 1, so that it is possible to enhance the insulation characteristic of this tightly fitted portion.

Furthermore, by the fitting of the support rod 26 into the engagement notch 25, the width of the fitting groove 23 is narrowed down, and the electrode plate 1 is tightly fitted by the jaw portion 24; and, furthermore, since the edge insulation member 20 is fixed to the electrode plate 1 by the fitting jig which is constituted by the pin 30 and stopper 40, thereby it is possible to enhance the security of the engagement between the electrode plate 1 and the edge insulation member 20, and there is no requirement to prevent the ingress of the electrolytic solution into the fitting groove 23 by the use of way as exemplified in the prior art.

Furthermore since, along with the edge insulation member 20 being fixed to the electrode plate 1 by the pin 30, also the edge insulation member 20 is fixed to the electrode plate 1 by the stopper 40 being securely engaged to the electrode plate 1, therefore due to the fitting jig it is possible exceptionally to improve the fixing capability over the case with the prior art, and it is also possible to reduce the fitting portion for the fitting jig upon the edge insulation member 20 to less than the case in the prior art (for example, the fitting portion for the fitting jig upon the edge insulation member 20 can be made to be about ⅓ what it was in the prior art). Furthermore the pin 30 does not deviate from the stopper 40 during its fitting, or due to shock or the like when removing electrodeposited cathode material from the electrode plate.

Furthermore, since the pin 30 is fixed by the stopper 40, it is not necessary to fix the pin 30 to the edge insulation member 20 by fusion, so that the work of fitting the pin 30 is easy.

Next, a removal method for the edge insulation member 20 will be explained.

The edge insulation member 20 can easily be removed from the electrode plate 1 by removing the support rod 26 from the engagement notch 25 and taking out the pin 30. At this time, by applying pushing force to the punched portion which is formed upon the grip portion 32 of the pin 30, it is possible easily to remove the grip portion 32 by grinding, so that it is possible simply to remove the stopper 40 from the pin insertion hole 27.

Since in this manner the pins 30 are not fixed by fusion into the edge insulation member 20, it is possible easily to remove the pins 30, and the edge insulation member 20 is not injured when taking out these pins 30. Accordingly, the product life for the edge insulation member 20 is long, since it can be reused just by changing the pins 30.

INDUSTRIAL APPLICABILITY

With the edge insulation member of the present invention, it is possible to increase the quality of secure engagement with the electrode plate, and it is possible to insulate the edge portion of the electrode plate perfectly, and moreover it is possible to maintain this secure engagement quality over a long period. Furthermore, repeated use is possible, since the process of removal from and attachment to the electrode plate is easy. Yet further, the anti impact characteristic and the like excel in strength, and the process of ablation of electrodeposited cathode material can also be performed easily.

Furthermore, since moreover no wax is used in the fixing method for the edge insulation member of the present invention, accordingly it is possible to fix strongly with an increased quality of secure engagement between the electrode plate and the edge insulation member, and it is possible to increase the quality of insulation of the electrode plate edge portion. Therefore, in the process of electrolytic refinement, there is no mixing in to the electrodeposited cathode material of material due to the edge insulation member, so that it is possible to obtain a refined material of good product quality.

Furthermore since, with the removal method for the edge insulation member of the present invention, it is possible easily to remove the edge insulation member from the electrode plate, and there is no destruction of the edge insulation member, accordingly it becomes possible to reuse the edge insulation member.

According to the fitting jig for the edge insulation member of the present invention, it is possible securely to engage and fix the edge insulation member to the electrode plate. Furthermore, it is easy to attach and remove to the edge insulation member.

What is claimed is:

1. An edge insulation member which is attached to an edge portion of an electrode plate during a process of electrolytic refinement of a metal, including a rod shaped main body, a fitting jig which consists of a pin and a stopper, and a support rod;

wherein a fitting groove and a jaw portion for tightly fitting and fixing the electrode plate are formed on a tip portion of the rod shaped main body to extend along the lengthwise direction of the main body, an engagement notch for fitting the support rod is formed on a base end portion of the main body to extend along the lengthwise direction of the main body, a plurality of pin insertion holes are formed on the side surface of the jaw portion;

the fitting jig is removably fitted in the pin insertion hole, and the support rod is removably fitted in the engagement notch.

2. An edge insulation member as described in claim 1, wherein the stopper includes:

a ring shaped fixing portion which can be fixed into the pin insertion hole of the insulation member;

an insertion hole which is provided so that its diameter reduces from this fixing portion towards the other end;

a slit sleeve which is provided on the side wall surface of the reducing diameter portion of this insertion hole, and in which a slit has been formed in its longitudinal direction; and the slit sleeve has a structure in which, by inserting the pin into the slit sleeve, the slit sleeve is expanded in the circumferential direction.

3. An edge insulation member as described in claim 2, wherein the slit sleeve includes an inclined portion which makes an angle of inclination of 3° to 45° with respect to the direction of insertion of the pin.

4. An edge insulation member as described in claim 1, wherein the pin includes a main body, a grip portion which is formed upon a starting end portion of the main body, and one or a plurality of key portions which are formed on side surfaces of the main body.

5. An edge insulation member as described in claim 1, wherein the main body of the edge insulation member and the pin are made from resin, and the stopper is made from an elastomer whose elasticity is higher than the resin which is used for the main body and pin.

6. An edge insulation member as described in claim 1, wherein at least one of the main body, the fitting jig made up of the pin and the stopper, and the support rod consists of a metal core enclosed within a resin.

7. An edge insulation member as described in claim 1, wherein the support rod is a circular cylindrical body with a circular cross sectional shape.

8. An edge insulation member as described in claim 1, wherein the support rod is an elliptical cylindrical body with a elliptical cross sectional shape.

9. An edge insulation member as described in claim 1, wherein a seal member is adhered to the surface of the fitting groove.

10. An edge insulation member as described in claim 1, wherein an adhesive layer is provided on the surface of the fitting groove.

11. A fixing method for fixing an edge insulation member to an edge portion of an electrode plate:

wherein the edge insulation member includes a rod shaped main body, a fitting jig which is made up from a pin and a stopper, and a support rod;

on a tip portion of the rod shaped main body, a fitting groove and a jaw portion for tightly fitting and fixing the electrode plate are formed to extend along the lengthwise direction of the main body, on a base end portion of the main body, an engagement notch for fitting the support rod is formed to extend along the lengthwise direction of the main body, a plurality of pin insertion holes are formed on the side surface of the jaw portion, the fitting jig to be removably fitted in the pin insertion hole, and the support rod to be removably fitted in the engagement notch;

the fixing method including:

a process of forming a plurality of pin insertion holes at predetermined places of the electrode plate edge portion;

a process of fitting the electrode plate to the fitting groove of the edge insulation member, so that the pin insertion holes of this electrode plate edge portion are superimposed upon the pin insertion holes of the above described edge insulation member;

a process of tightly fitting the electrode plate by the jaw portion, by fitting the support rod in the engagement notch of the edge insulation member so as to expand the engagement notch;

a process of fitting the stopper in the pin insertion hole of the edge insulation member; and a process of inserting the pin in the pin insertion hole of the edge insulation member and the pin insertion hole of the electrode plate, fixing this pin by the stopper, and fixing the edge insulation member to the electrode plate.

12. A fixing method for an edge insulation member as described in claim 11, wherein:

as the stopper, there is utilized one including a ring shaped fixing portion which is fixed in the pin insertion hole of the insulation member, an insertion hole which is provided so as to reduce in diameter from this fixing portion towards its other end, and a slit sleeve which is provided on the side wall surface of the reducing diameter portion of this insertion hole, and with a slit being formed in its longitudinal direction;

and the method further includes a process of inserting the pin into this stopper, and expanding the slit sleeve of the stopper in the circumferential direction, so as securely to engage the slit sleeve to the electrode plate.

13. A fixing method for an edge insulation member as described in claim 11, wherein, as the support rod, there is used a circular cylindrical body having a circular cross sectional shape.

14. A fixing method for an edge insulation member as described in claim 11, wherein, as the support rod, there is used an elliptical cylindrical body having a elliptical cross sectional shape.

15. A fixing method for an edge insulation member as described in claim 11, wherein the electrode plate is fitted into the fitting groove of the edge insulation member by inserting the electrode plate into the fitting groove of the edge insulation member, and by adhering a seal member which is adhered to the surface of the fitting groove to the electrode plate.

16. A fixing method for an edge insulation member as described in claim 11, wherein the electrode plate is fitted into the fitting groove of the edge insulation member by inserting the electrode plate into the fitting groove of the edge insulation member, and by securely engaging an adhesive layer which is provided on the surface of the fitting groove to the electrode plate.

17. A fixing method for an edge insulation member as described in claim 11, wherein at least one of the main body, the fitting jig made up of the pin and the stopper, and the support rod having a metal core enclosed within a resin.

18. A removal method for an edge insulation member, including taking out the support rod of an edge insulation member which is fixed to the electrode plate by a fixing method for an edge insulation member as described in claim 11 from the engagement notch, removing the grip portion of the pin by grinding, and removing the edge insulation member from the electrode plate by extracting the pin.

19. A fitting jig, including a stopper and a pin which fix an edge insulation member which is fitted to an edge portion of an electrode plate which is used in a process of electrolytic refining of a metal to the electrode plate, wherein:

the pin includes a main body, a grip portion which is formed at a starting end portion of the main body, and one or a plurality of key portions which are formed on side surfaces of the main body; and the stopper includes a ring shaped fixing portion, an insertion hole which is provided so as to reduce in diameter from this fixing portion towards its other end, and a slit sleeve which is provided on the side wall surface of the reducing diameter portion of this insertion hole, and with a slit being formed in its longitudinal direction; and has a structure such that, by the pin being inserted into the stopper, the slit sleeve is expanded in the circumferential direction, so as to fix the pin.

* * * * *